US010221049B1

(12) United States Patent
Horton

(10) Patent No.: US 10,221,049 B1
(45) Date of Patent: Mar. 5, 2019

(54) LIFT ATTACHMENT APPARATUS

(71) Applicant: Jared D. Horton, Glenwood, IA (US)

(72) Inventor: Jared D. Horton, Glenwood, IA (US)

( * ) Notice: Subject to any disclaimer, the term of this patent is extended or adjusted under 35 U.S.C. 154(b) by 0 days.

(21) Appl. No.: 15/143,279

(22) Filed: Apr. 29, 2016

Related U.S. Application Data

(60) Provisional application No. 62/154,541, filed on Apr. 29, 2015.

(51) Int. Cl.

| | |
|---|---|
| ***B66C 23/44*** | (2006.01) |
| ***E02F 3/96*** | (2006.01) |
| *E02F 3/34* | (2006.01) |
| *B66F 9/12* | (2006.01) |

(52) U.S. Cl.
CPC ..... *B66C 23/44* (2013.01); *E02F 3/96* (2013.01); *B66F 9/12* (2013.01); *E02F 3/3414* (2013.01)

(58) Field of Classification Search
CPC ..... E02F 3/3414
USPC ..... 414/723
See application file for complete search history.

(56) References Cited

U.S. PATENT DOCUMENTS

| | | | | |
|---|---|---|---|---|
| 1,368,619 | A | | 2/1921 | Fleury |
| 2,301,808 | A | | 11/1942 | Mosher |
| 2,493,150 | A | | 1/1950 | Kroger |
| 2,719,730 | A | | 10/1955 | Beck |
| 2,788,906 | A | | 4/1957 | Davis et al. |
| 2,899,093 | A | | 8/1959 | Morrell |
| 3,042,236 | A | | 7/1962 | Pilch |
| 3,123,222 | A | | 3/1964 | Livingston et al. |
| 3,204,793 | A | | 9/1965 | Lane |
| 3,812,979 | A | | 5/1974 | Leihgeber |
| 4,200,423 | A | | 4/1980 | Sornsin |
| 4,436,477 | A | | 3/1984 | Lenertz et al. |
| 4,960,359 | A | | 10/1990 | Lovitt, Jr. |
| 5,054,989 | A | | 10/1991 | Fell |
| 5,120,186 | A | * | 6/1992 | Jorgenson ..... B66C 23/44 212/181 |
| 5,169,278 | A | | 12/1992 | Hoechst et al. |
| 5,171,124 | A | | 12/1992 | Foster |
| D374,752 | S | | 10/1996 | Lee et al. |
| 5,611,657 | A | | 3/1997 | Peterson |
| 5,921,743 | A | | 7/1999 | Slagter |
| 5,975,826 | A | | 11/1999 | Scholder |
| 6,551,050 | B1 | | 4/2003 | Kallevig et al. |
| 6,840,334 | B2 | | 1/2005 | Marquardt |

(Continued)

*Primary Examiner* — Ronald P Jarrett
(74) *Attorney, Agent, or Firm* — Suiter Swantz pc llo

(57) ABSTRACT

The present disclosure is a lift attachment apparatus for construction and farm equipment, including a loader. In an embodiment of the disclosure, lift apparatus may include a frame including an attachment device configured to attach to a tilting plane of a loader having a forward facing loader arm, a pair of wheels connected to the frame, a first wheel of the pair of wheels located on a first side of the frame and a second wheel of the pair of wheels located on a second side of the frame, the first wheel configured to be maintained parallel to the second wheel. The lift attachment apparatus may further include a boom connected to the frame, wherein control of the boom is provided by application of force to the attachment device by the forward facing loader arm in a downward direction to create lift and rotation of the tilting plane causing rotation of an end of the boom about the first wheel and the second wheel.

7 Claims, 16 Drawing Sheets

(56) References Cited

U.S. PATENT DOCUMENTS

| | | | |
|---|---|---|---|
| 6,851,486 | B2 | 2/2005 | Marshall |
| 7,273,342 | B2 | 9/2007 | DeSilvio |
| 7,314,342 | B2 | 1/2008 | Kerwin |
| 7,454,850 | B2 | 11/2008 | Smith |
| 7,926,583 | B2 | 4/2011 | Newnam |
| 8,167,053 | B2 | 5/2012 | Hendron et al. |

* cited by examiner

LIFT ATTACHMENT APPARATUS

CROSS REFERENCE TO RELATED APPLICATIONS

The present application claims the benefit under 35 U.S.C. § 119(e) of U.S. Provisional Application Ser. No. 62/154,541 filed Apr. 29, 2015. The U.S. Provisional Application Ser. No. 62/154,541 is hereby incorporated by reference in its entirety.

TECHNICAL FIELD

The present disclosure generally relates to the field of construction; and more specifically to a lift attachment apparatus for farm and construction equipment.

BACKGROUND

Farm and construction equipment are regularly employed in a variety of applications to move material. Construction and farm equipment may include loader equipment with wheels, tracks or other system that makes them mobile for the use of moving or processing material with quick attachment capabilities. Loaders may include track skid loader, skid steer loader, all wheel steer loader, wheel loader, crawler loader or a front end loader.

It is common for a loader to include a bucket to contain material. Advantageously, material may be retrieved, stored, transported and deposited in another location. Material retrieved within the bucket may include snow, dirt, cement, rock and the like. It is also contemplated that other types of attachments may be attached to the loader in order to improve the functionality of the loader. These attachments may include blades, forks, brooms, and auger bits.

SUMMARY

The present disclosure is directed to a lift attachment apparatus for construction and farm equipment, including a loader. In an embodiment of the disclosure, lift apparatus may include a frame including an attachment device configured to attach to a tilting plane of a loader having a forward facing loader arm, a pair of wheels connected to the frame, a first wheel of the pair of wheels located on a first side of the frame and a second wheel of the pair of wheels located on a second side of the frame, the first wheel configured to be maintained parallel to the second wheel. The lift attachment apparatus may further include a boom connected to the frame, wherein control of the boom is provided by application of force to the attachment device by the forward facing loader arm in a downward direction to create lift and rotation of the tilting plane causing rotation of an end of the boom about the first wheel and the second wheel.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1A:
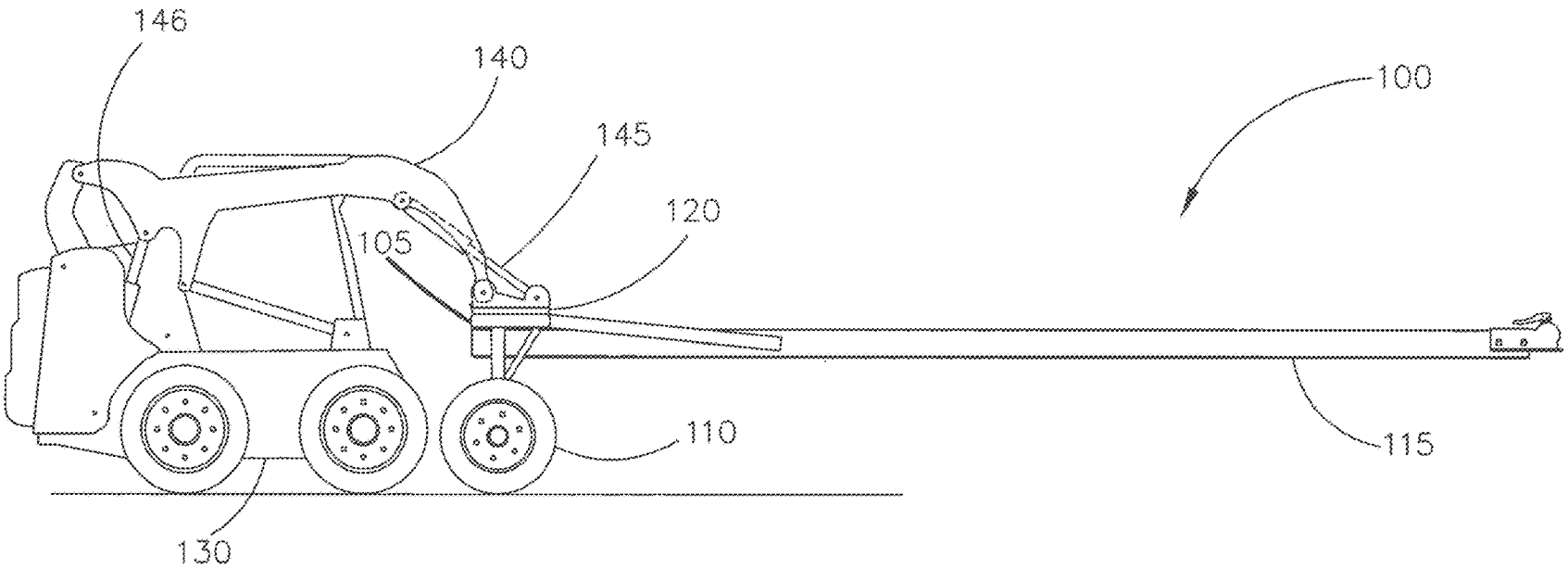
FIGS. 1A-1D depict side views of a lift attachment apparatus in accordance with an embodiment of the present disclosure.

Reference will now be made in detail to the subject matter disclosed, which is illustrated in the accompanying drawings.

The present disclosure is directed to a lift attachment apparatus for construction and farm equipment, including a loader. In an embodiment of the disclosure, lift apparatus may include a frame including an attachment device configured to attach to a tilting plane of a loader having a forward facing loader arm, a pair of wheels connected to the frame, a first wheel of the pair of wheels located on a first side of the frame and a second wheel of the pair of wheels located on a second side of the frame, the first wheel configured to be maintained parallel to the second wheel. The lift attachment apparatus may further include a boom connected to the frame, wherein control of the boom is provided by application of force to the attachment device in a downward direction by the forward facing loader arm to create lift and rotation of the tilting plane causing rotation of an end of the boom about the first wheel and the second wheel.

Before any embodiments of the disclosure are explained in detail, it is to be understood that the embodiments may not be limited in application per the details of the structure or the function as set forth in the following descriptions or illustrated in the figures. Different embodiments may be capable of being practiced or carried out in various ways. Also, it is to be understood that the phraseology and terminology used herein is for the purpose of description and should not be regarded as limiting. The use of terms such as "including," "comprising," or "having" and variations thereof herein are generally meant to encompass the item listed thereafter and equivalents thereof as well as additional items. Further, unless otherwise noted, technical terms may be used according to conventional usage. It is further contemplated that like reference numbers may describe similar components and the equivalents thereof.

Referring to FIGS. 1A-1D, side views of a lift attachment apparatus 100 in accordance with an embodiment of the present disclosure are shown. Lift attachment apparatus may include a frame, the frame including an attachment device 105. Attachment device 105 may be configured to attach to a tilting plane of a loader. It is contemplated that attachment device 105 may be a quick attachment device in use with various types of attachments to connect with loaders. It is contemplated that a quick attachment device may be a device which allows a user to attach and detach attachments with a connection without difficult assembly and disassembly. Additionally, a quick attachment device may not require specialized tools which may allow for attachment and detachment of attachments in the field. A pair of wheels 110 may be coupled to the frame. It is contemplated that a first wheel of the pair of wheels may be located on a first side of the frame and a second wheel of the pair of wheels may be located on a second side of the frame, the first wheel configured to be maintained parallel to the second wheel. In an embodiment, each wheel may include a tire. Apparatus 100 may further include a boom 115 connected to the frame.

Figure 1B:
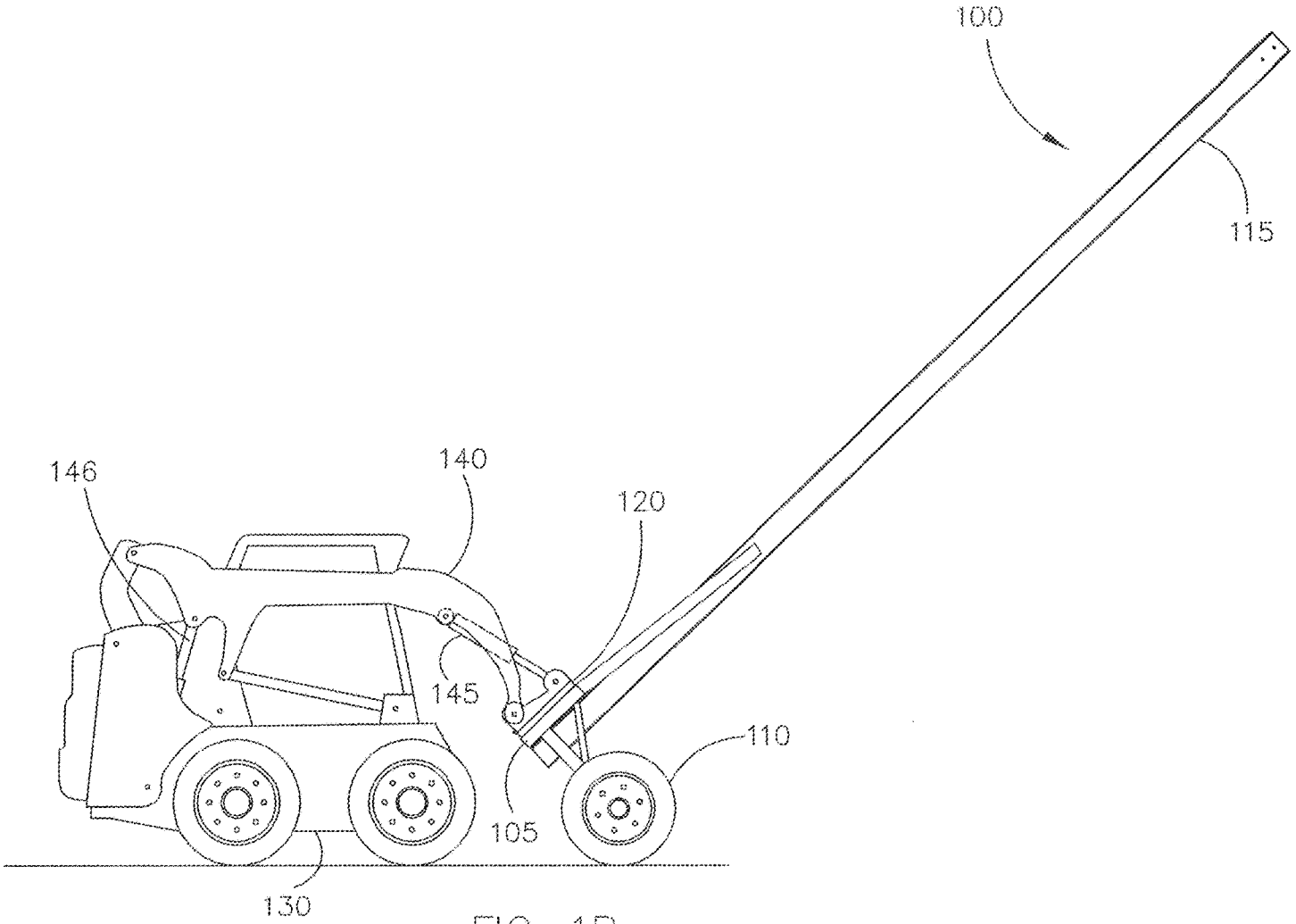
Figure 1C:
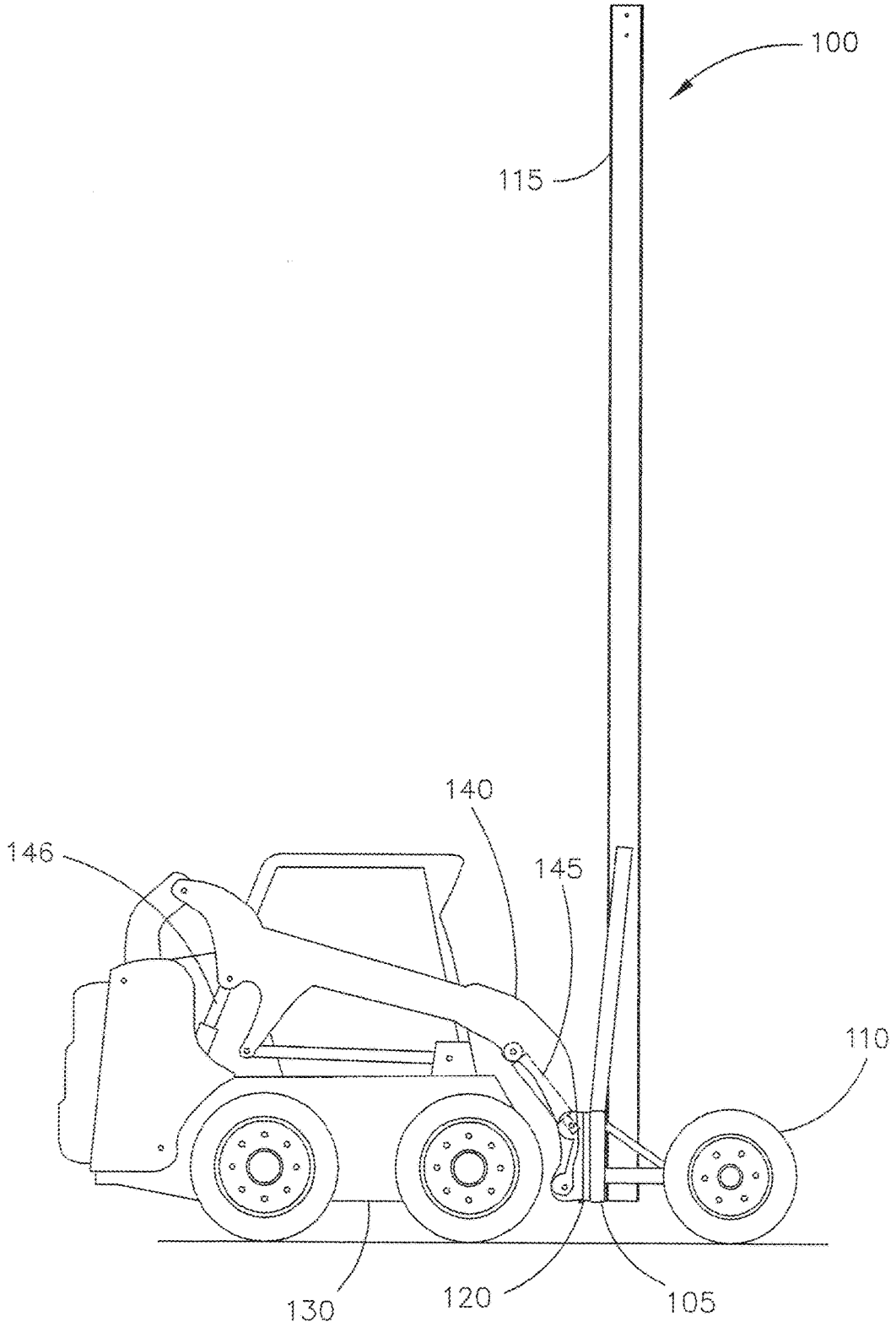

Advantageously, it is contemplated that various items (e.g. a load) may be removably coupled to an end of boom 115 and may be lifted to a desired location. Lift attachment apparatus 100 according to present disclosure may be configured to be safely rotated from a horizontal position as shown in FIG. 1A to a near vertical position (near 90 degrees to a surface) as shown in FIG. 1C without risking the load or tipping an attached loader. Attachment device 105 of frame may be configured to attach to a tilting plane 120 of a loader 130 having a forward facing loader arm 140. It is contemplated that attachment device 105 may be permanently fixed or incorporated with tilting plane 120 according to an alternative embodiment of the present disclosure. Boom 115 may be generally fixed with the attachment device 105 of the frame. It is contemplated that control of the boom 115 is provided by application of force to the attachment device 105 by the forward facing loader arm 140 in a downward direction to create lift and rotation of the tilting plane 120 causing rotation of an end of the boom about the first wheel and the second wheel of the pair of wheels 110. Tilting plane 120 may be controlled by a hydraulic cylinder 145 of loader. It is contemplated that boom 115 may be configured to be tipped up via application of force to the attachment device 105 in a downward direction and via reverse action of hydraulic cylinder 146 of the forward facing loader arm 140 of the loader 130. Through reverse action, the hydraulic capacity may be reduced, such as by about 44%. This reduction in hydraulic capacity may make it difficult to overload the apparatus 100 attachment if the load is being raised. Since the hydraulic capacities of hydraulic cylinders of many loaders are just over their tipping capacity, the reduction in hydraulic capacity may put the apparatus well below the tipping capacity and higher than the safe operating capacity.

Figure 1D:
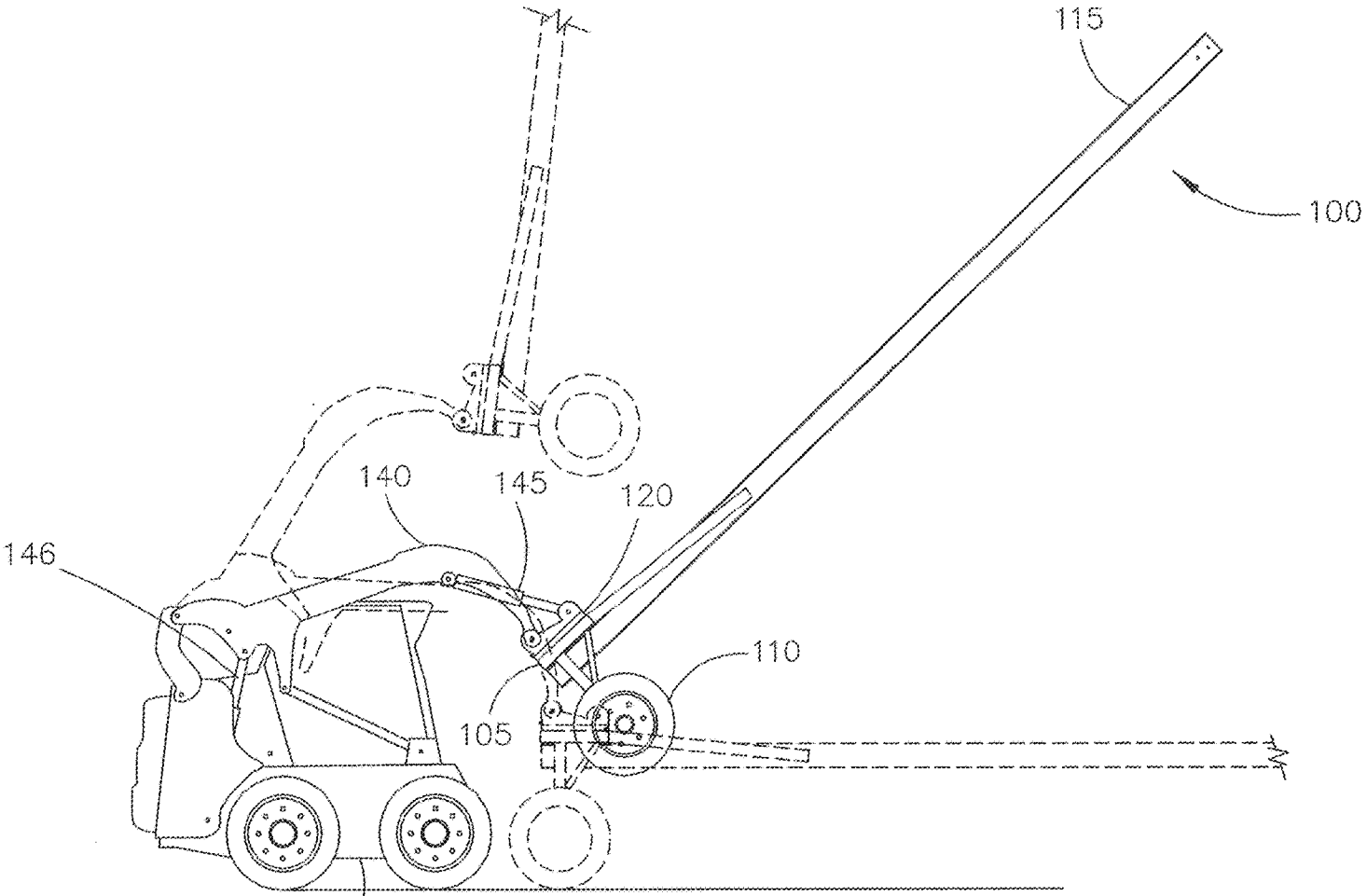

Referring to FIG. 1D, it is contemplated that lift attachment apparatus 100 may be raised by forward facing loader arm 140 whereby pair of wheels 110 may be supported by a raised surface or a vertical surface in accordance with embodiments of the disclosure to further increase the height by which an end of the boom may reach.

Referring again to FIGS. 1A-1D, boom 115 is configured as a long rod or pole. While not shown, it is contemplated that boom 115 may include a trolley beam. Boom 115 may also include one or more of an aperture, hook, connectors and the like to allow coupling to material for transport. It is contemplated that boom 115 may be constructed of steel, and may be tubular in nature. However, boom 115 may be formed of various cross section shapes such as rectangular, round, triangle, roman arch, or gothic arch. Boom 115 may be constructed as a skeletal body. Boom 115 may be constructed of other materials instead of or in addition to steel, including aluminum, wood, plastic, carbon fiber, composites thereof and the like.

Loader 130 may include any type and size of loader. Loader 130 may be track skid loader, skid steer loader, all wheel steer loader, wheel loader, crawler loader or a front end loader. While loader 130 is described with a single forward facing loader arm 140, it is contemplated that two or more forward facing loader arms may be employed by a loader 130 without departing from the scope and intent of the present disclosure.

Figure 2:
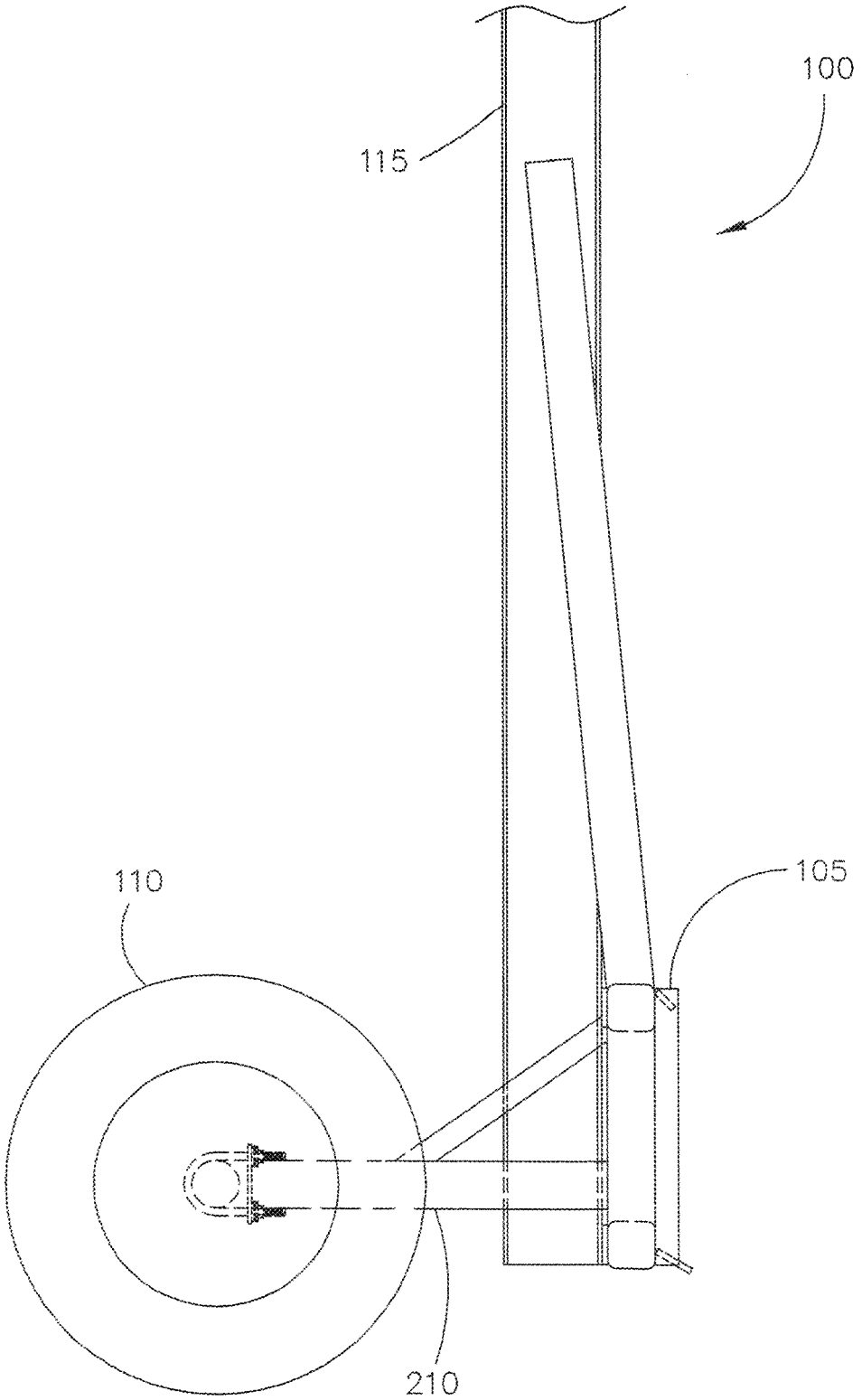
FIG. 2 depicts an exploded side view of a lift attachment apparatus in accordance with an embodiment of the present disclosure.

Referring to FIG. 2, an exploded side view of a lift attachment apparatus 100 in accordance with an embodiment of the present disclosure is shown. It is contemplated that pair of wheels may be coupled to the frame via an axle 220. Frame may also include a coupler 210. Coupler 210 may refer to at least one arm that connects pair of wheels 110, via the axle 220, to the attachment device 105. In an embodiment of the disclosure, coupler 210 may be generally perpendicular to the attachment device 105. It is contemplated that coupler 210 may include a suspension device, solid cover (e.g. formed as a box), oriented at angles, and the like according to various embodiments of the present disclosure.

Figure 3A:
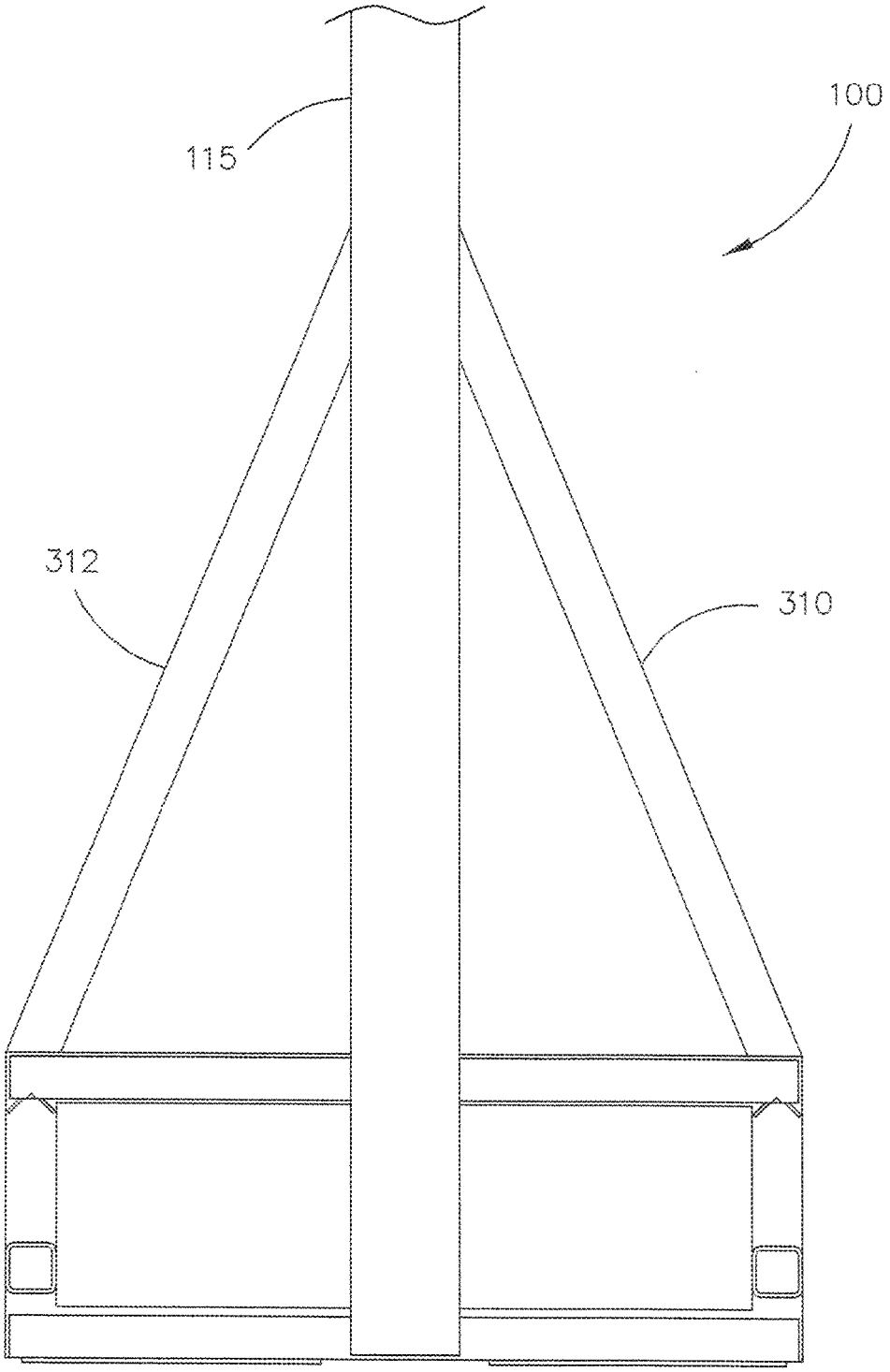
FIGS. 3A-3B depict bottom views of a lift attachment apparatus in accordance with an embodiment of the present disclosure.
Figure 3B:
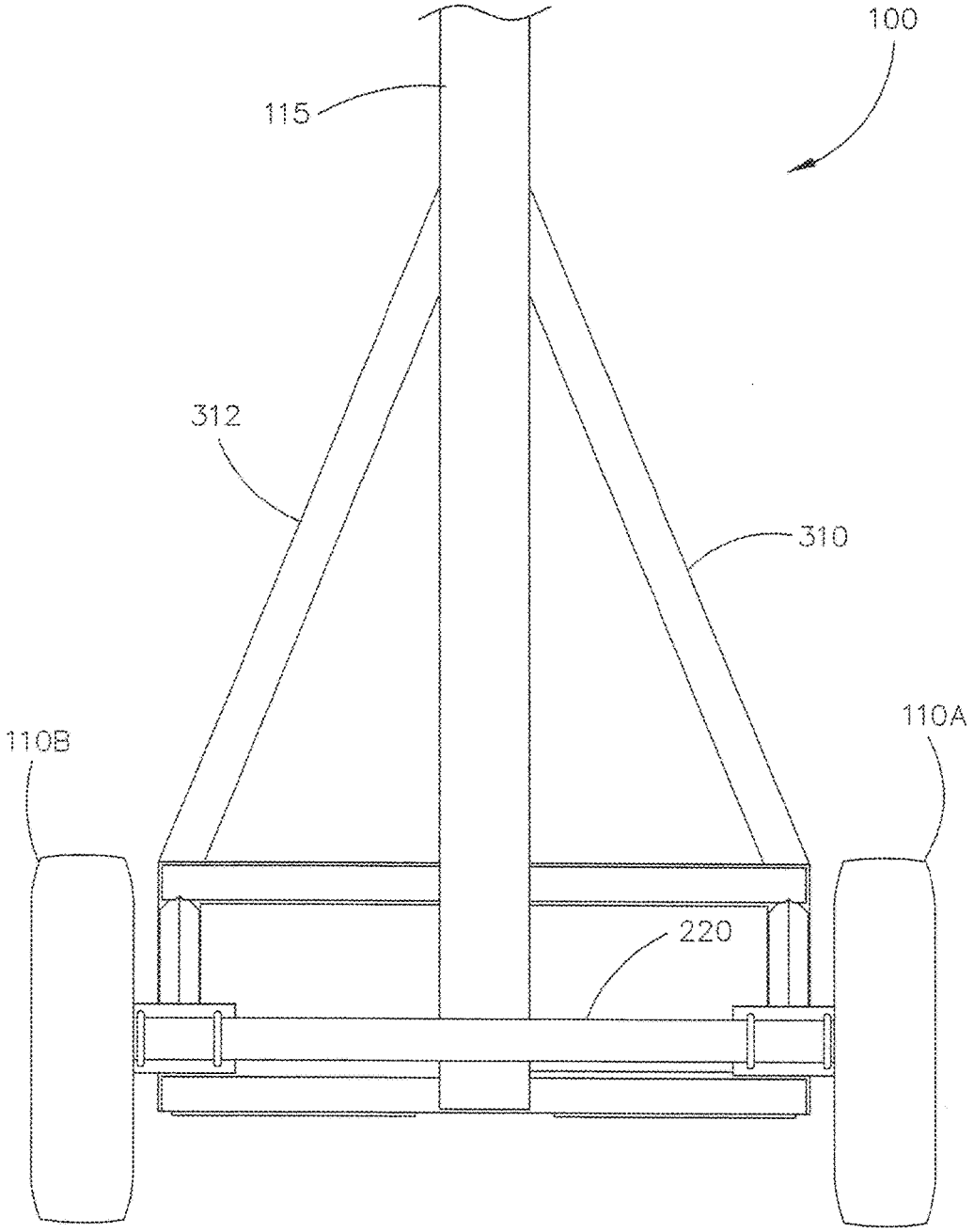
Figure 4:
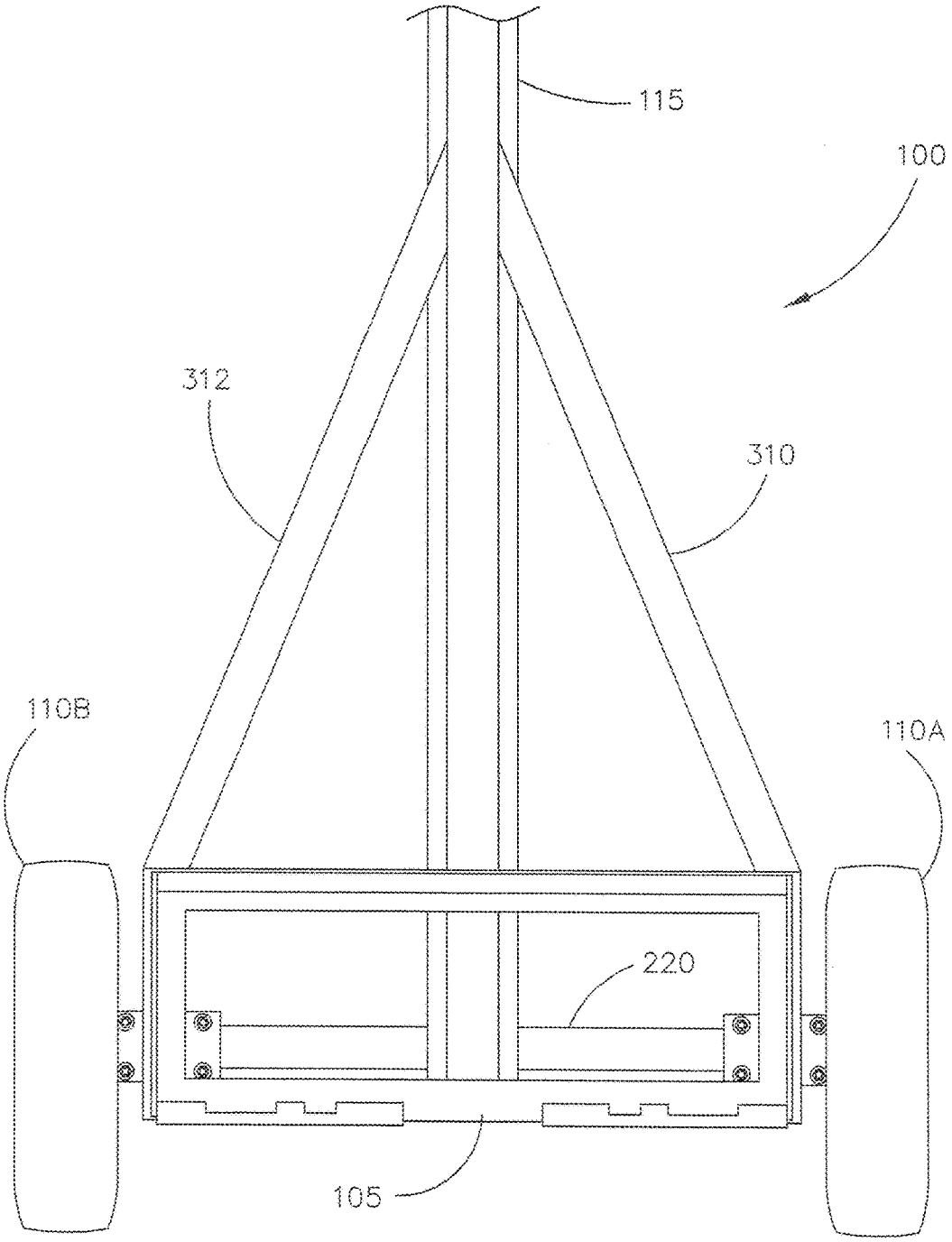
FIG. 4 depicts a top view of a lift attachment apparatus in accordance with an embodiment of the present disclosure.
Figure 5A:
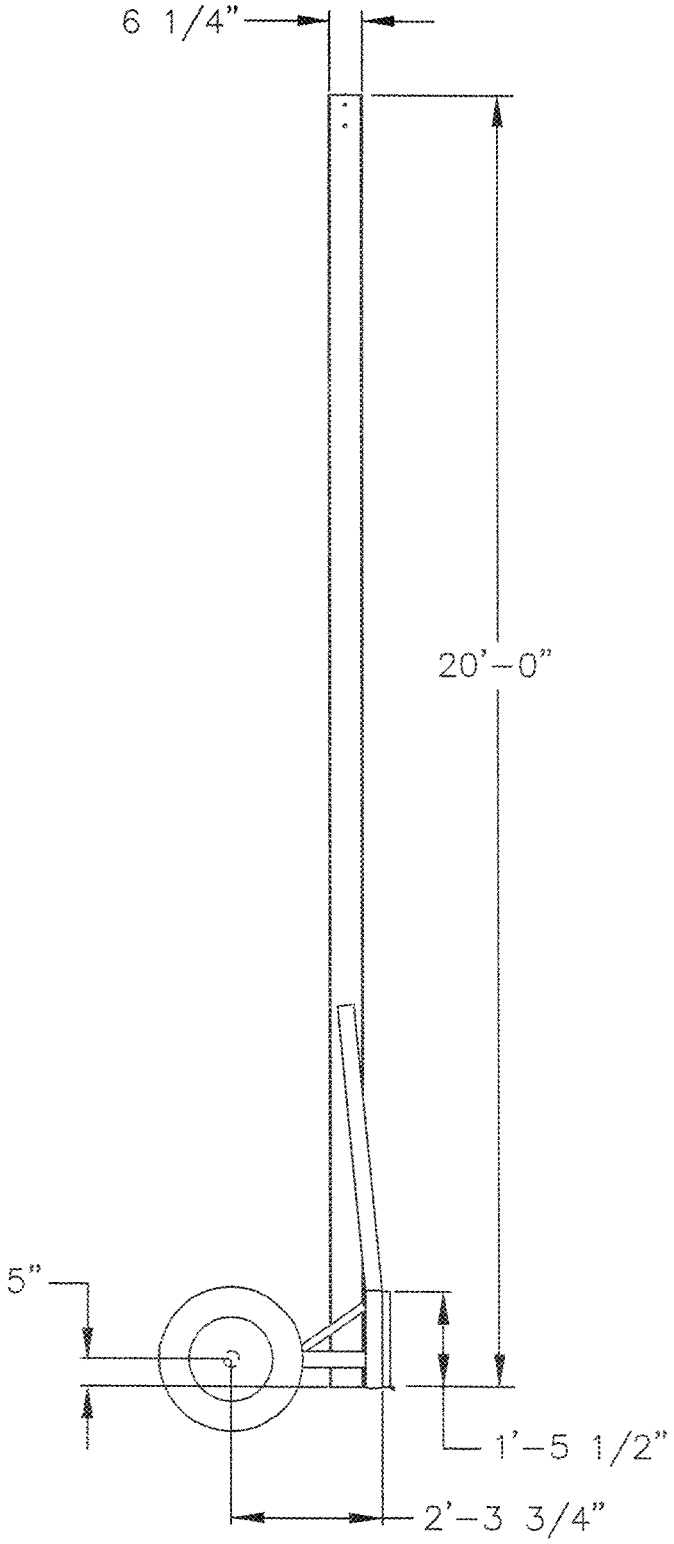
FIGS. 5A-5B depict exemplary dimensions of a lift attachment apparatus 100 in accordance with an embodiment of the present disclosure.
Figure 5B:
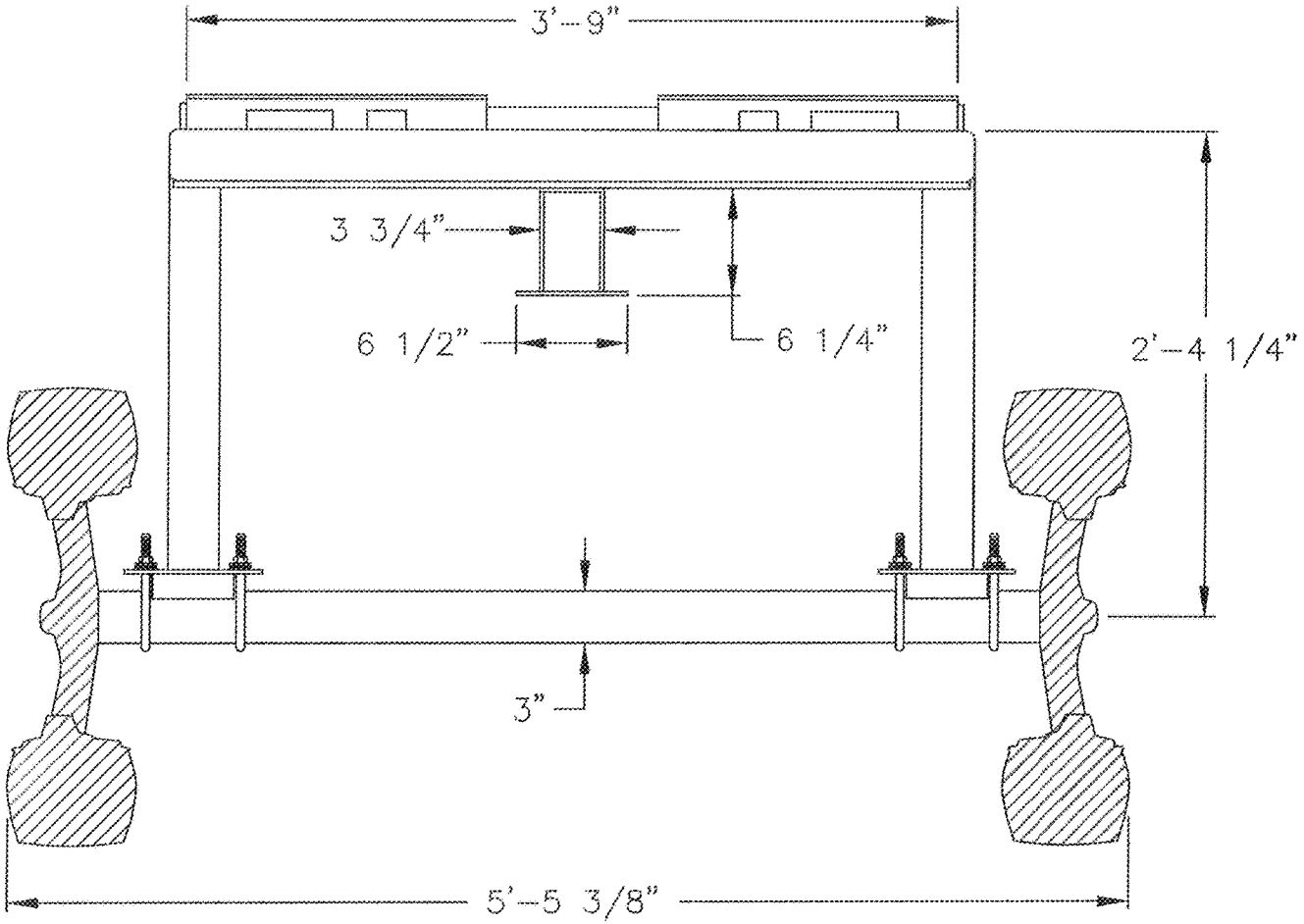

Referring to FIGS. 3A-3B, bottom views of a lift attachment apparatus in accordance with an embodiment of the present disclosure are shown. As shown, boom 115 may be implemented as a rod or pole. It is contemplated that frame of apparatus may include one or more supports 310, 312 to increase strength and lifting capacity of boom 115. As shown in FIG. 3B, pair of wheels 110A, 100B may be coupled to the frame via an axle. It is contemplated that a first wheel 110A of the pair of wheels may be located on a first side of the frame and a second wheel 110B of the pair of wheels may be located on a second side of the frame, the first wheel configured to be maintained parallel to the second wheel. In an embodiment, each wheel 110A, 110B may include a tire. Referring to FIG. 4, a top view of a lift attachment apparatus 100 in accordance with an embodiment of the present disclosure is shown. FIGS. 5A-5B depict exemplary dimensions of a lift attachment apparatus 100 in accordance with an embodiment of the present disclosure. While the dimensions shown in FIGS. 5A-5B may be employed, it is contemplated that the dimensions may be adjusted without departing from the scope and intent of the present disclosure.

Figure 6:
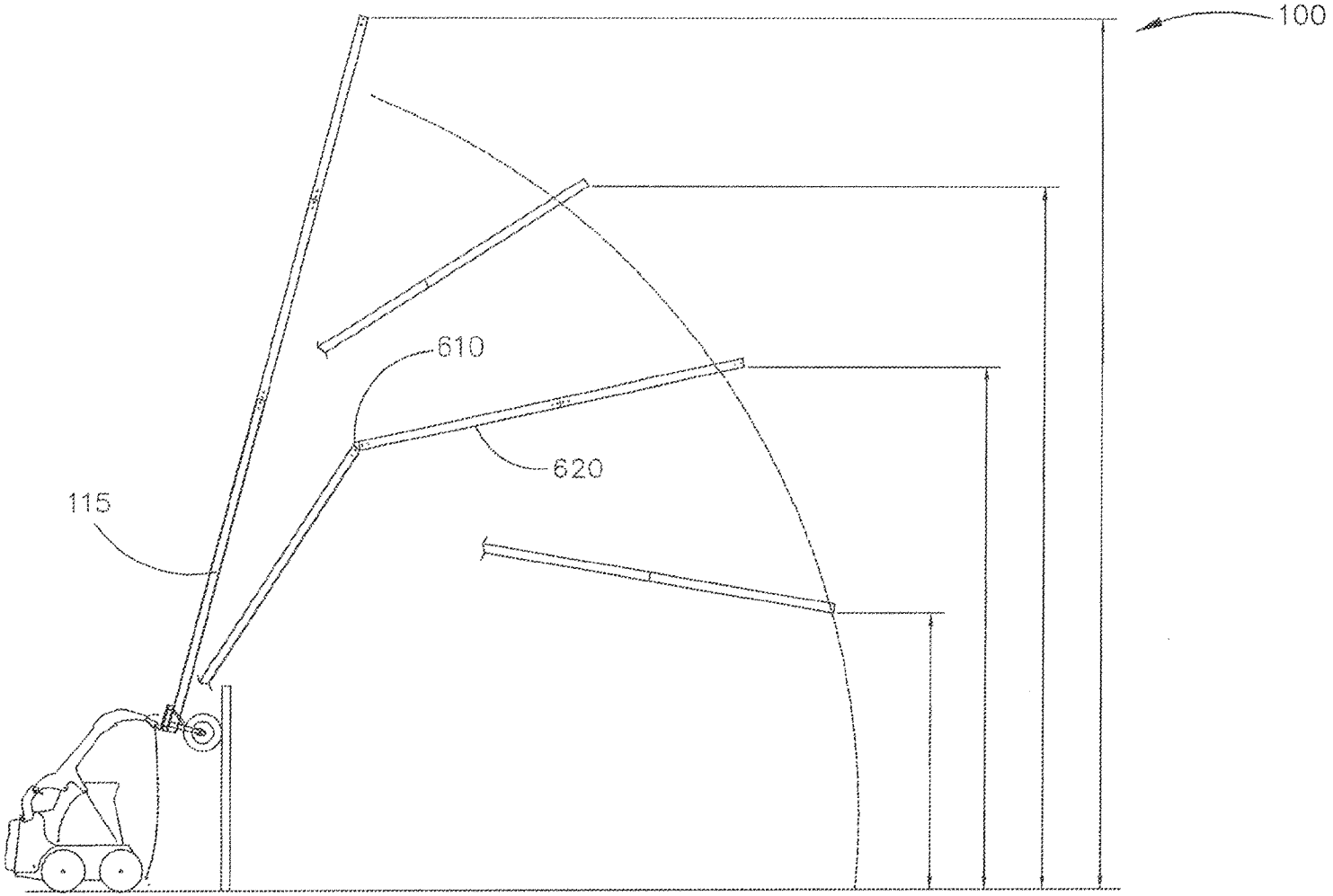
FIG. 6 depicts a lift attachment apparatus which further includes an additional extension rod in accordance with an embodiment of the present disclosure.

Referring to FIG. 6, a lift attachment apparatus 100 which further includes an additional extension rod in accordance with an embodiment of the present disclosure is shown. It is contemplated that boom 115 may further include a connector 610 coupled to an end of the boom. Connector 610 may connect boom 115 with an extension rod 620 to increase the height capacity and range of the lift apparatus 100 to exemplary heights such as $X_1$, $X_2$, $X_3$, and $X_4$. Connector 610 may be a straight connector, a 90 degree connector, or a 45 degree connector. Additionally, connector 610 may be an adjustable connector and also may range from 0 to 90 degrees. As shown in FIG. 6, lift attachment apparatus 100 may be supported against a vertical wall in order to increase the vertical range of the lift attachment apparatus 10. It is further contemplated that lift attachment apparatus 100 may be supported against a generally horizontal surface on a different horizontal elevation than the loader 130 to increase vertical range and horizontal range. It is further contemplated that boom 115 may further include a towing device configured to be coupled with an end of the boom 115 as shown in FIG. 1A. The towing device may include a receptacle to connect with a vehicle. For example, towing device may include a receptacle to connect with a ball hitch of a vehicle.

The lift attachment apparatus 100 as described and shown in FIGS. 1-6 provide a number of advantages and serve a long felt need. It is common that contractors may have access to a loader due to the reduced cost of a loader as compared to lifts and cranes. Additionally, through use of various attachments, loaders may be more likely to be owned due to their multiple functions, usability, and operability without specialized skill. However, previous implementations of booms with loaders are limited due to their low lift capacity, reach or mobility.

Lift attachment apparatus 100, by use of the pair of wheels 110, operating between the loader 130 and the load at the end of the boom 115, may operate as a lever. This configuration and capability to operate as a lever may dramatically improve the lift capacity of the boom 115 as compared to previous implementations. For example, the use of the pair of wheels 110 as the fulcrum, may allow an amplification of the input force provided by a loader 130 when applied to the attachment device 105 of the lift attachment apparatus 100 in order to provide a greater output force. It is contemplated that mechanical advantage of the lift attachment apparatus 100 may be greater when the pair of wheels 110 at the point to where the pair of wheels 110 come into contact with a surface is located between the attachment device 105 that is coupled to a tilting plane of a loader 130 and the load which is located at the end of the boom 115, as shown in FIG. 1B. Additionally, it is contemplated that a center point of the pair of wheels 110, (e.g. the point at which the wheels may contact the axle), may also be forward of the attachment device 105 and whereby mechanical advantage of the lift attachment apparatus 100 may be greater. Use of the lift attachment apparatus 100 may allow transport of material while the loader is located more than thirty feet away or greater, which may be particularly valuable in muddy conditions or other conditions in which a surface is not solid.

Referring again to FIG. 2, attachment device 105, coupler, 210, and pair of wheels 110 may be in proximity to each other. It is contemplated, in an alternative embodiment, that pair of wheels 110 and coupler 210 may be shifted toward the end of the boom 115 while the attachment device 105 remains in the present position as shown in FIG. 2. For example, it is contemplated that such design according to an alternative embodiment may be desirable for larger loads.

Figure 7:
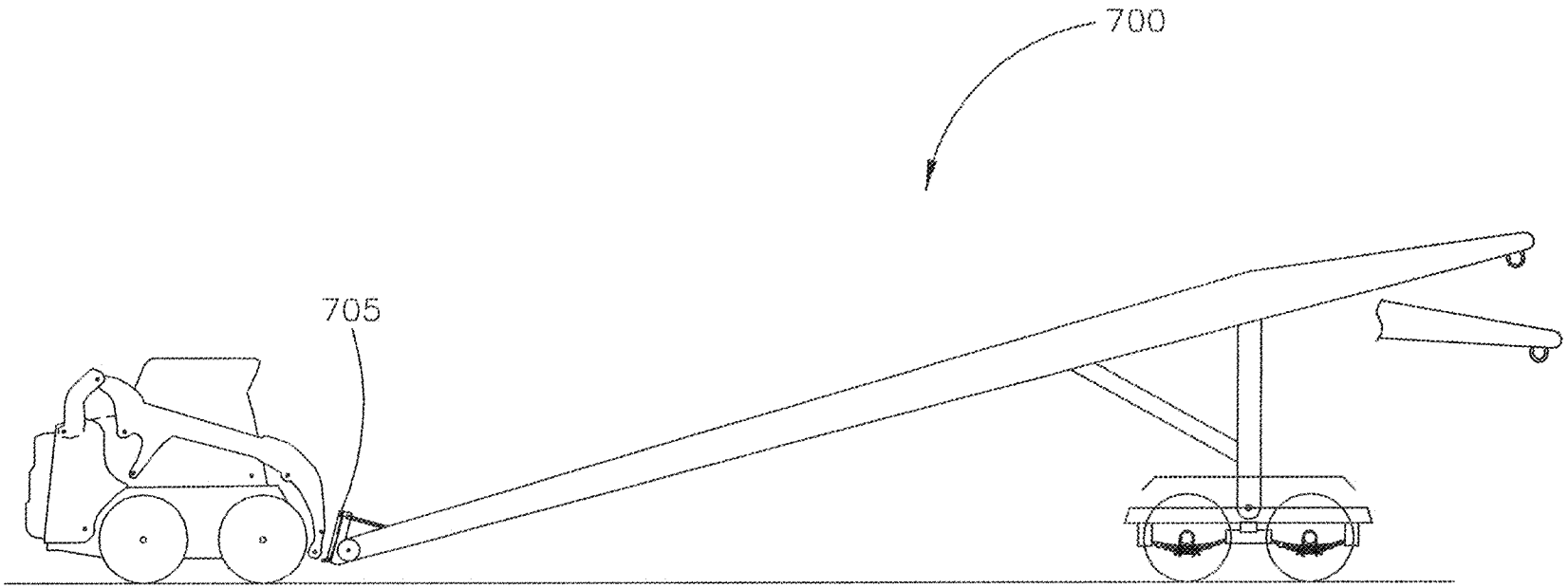
FIG. 7 depicts a lift attachment apparatus according to an alternative embodiment of the present disclosure.

Referring to FIG. 7, a lift attachment apparatus 700 according to an alternative embodiment of the present disclosure is shown. Lift attachment apparatus 700 may include an attachment plate 705. Attachment plate 705 may be configured to attach to a tilting plane of a loader. It is contemplated that attachment device 705 may be a quick attachment device in use with various types of attachments to connect with loaders. Lift attachment apparatus 705 may include a pair of wheels, or may include multiple pairs of wheels. It is contemplated that lift attachment apparatus 700 may be suitable for substantially heavy loads.

Figure 8A:
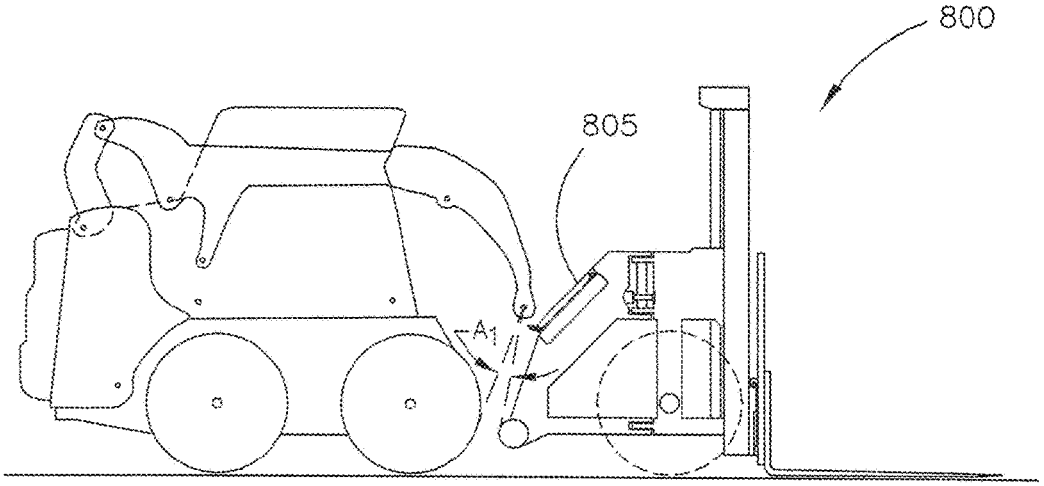
FIGS. 8A-8G depict a lift attachment apparatus according to an additional alternative embodiment of the present disclosure.
Figure 8B:
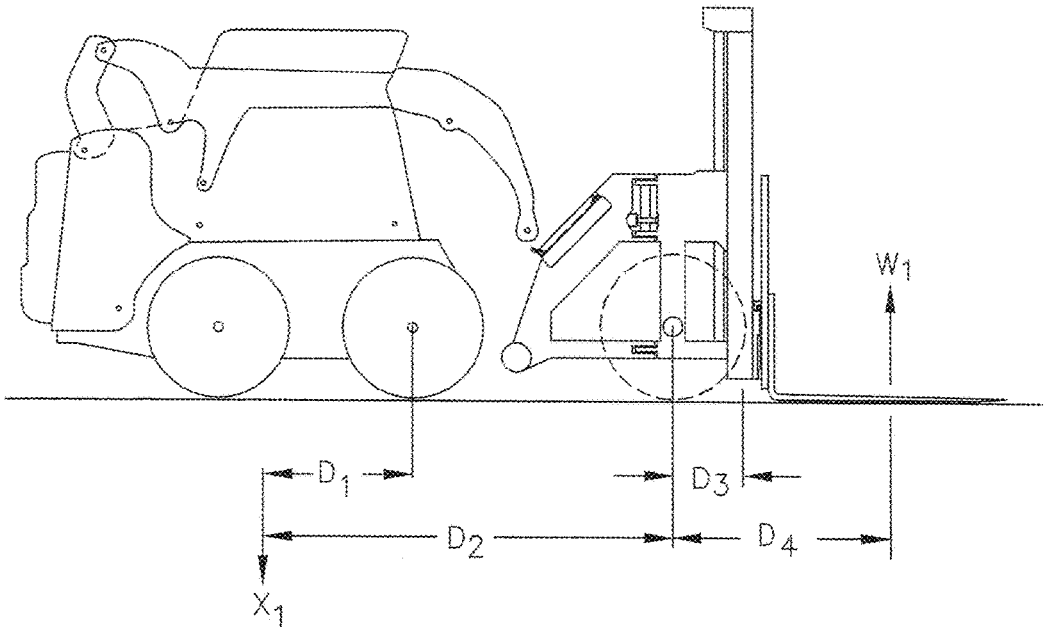
Figure 8C:
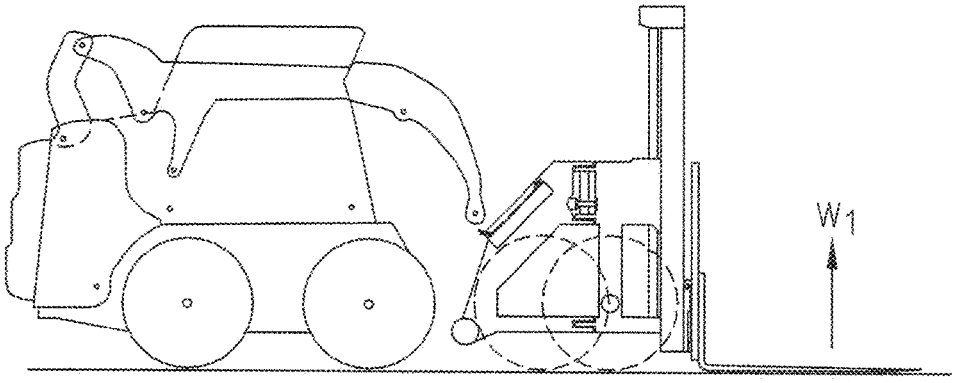
Figure 8D:
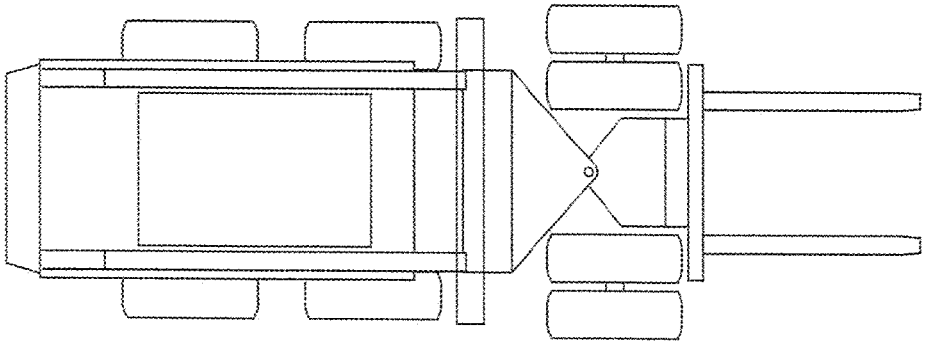
Figure 8E:
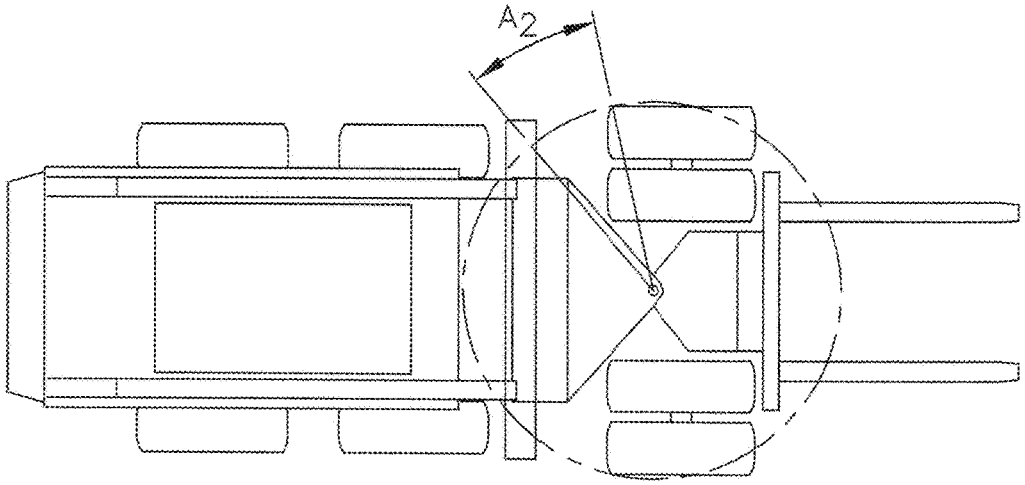
Figure 8F:
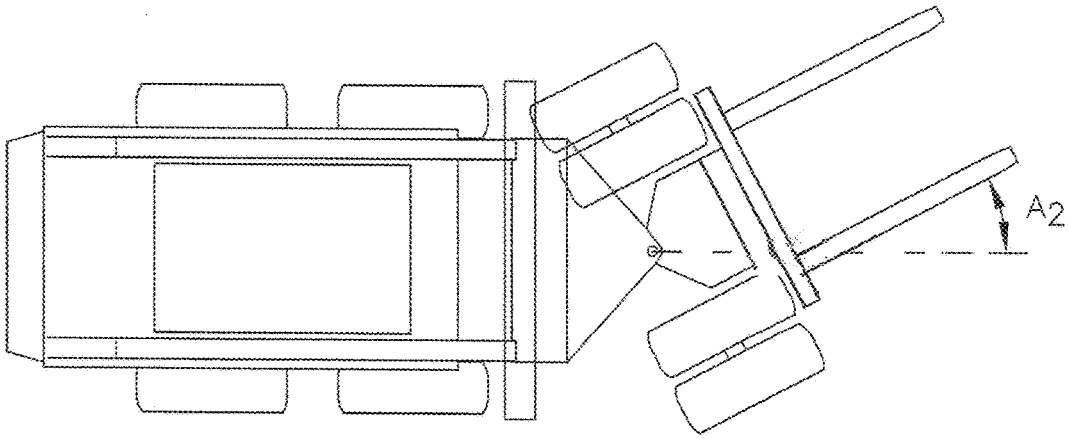
Figure 8G:
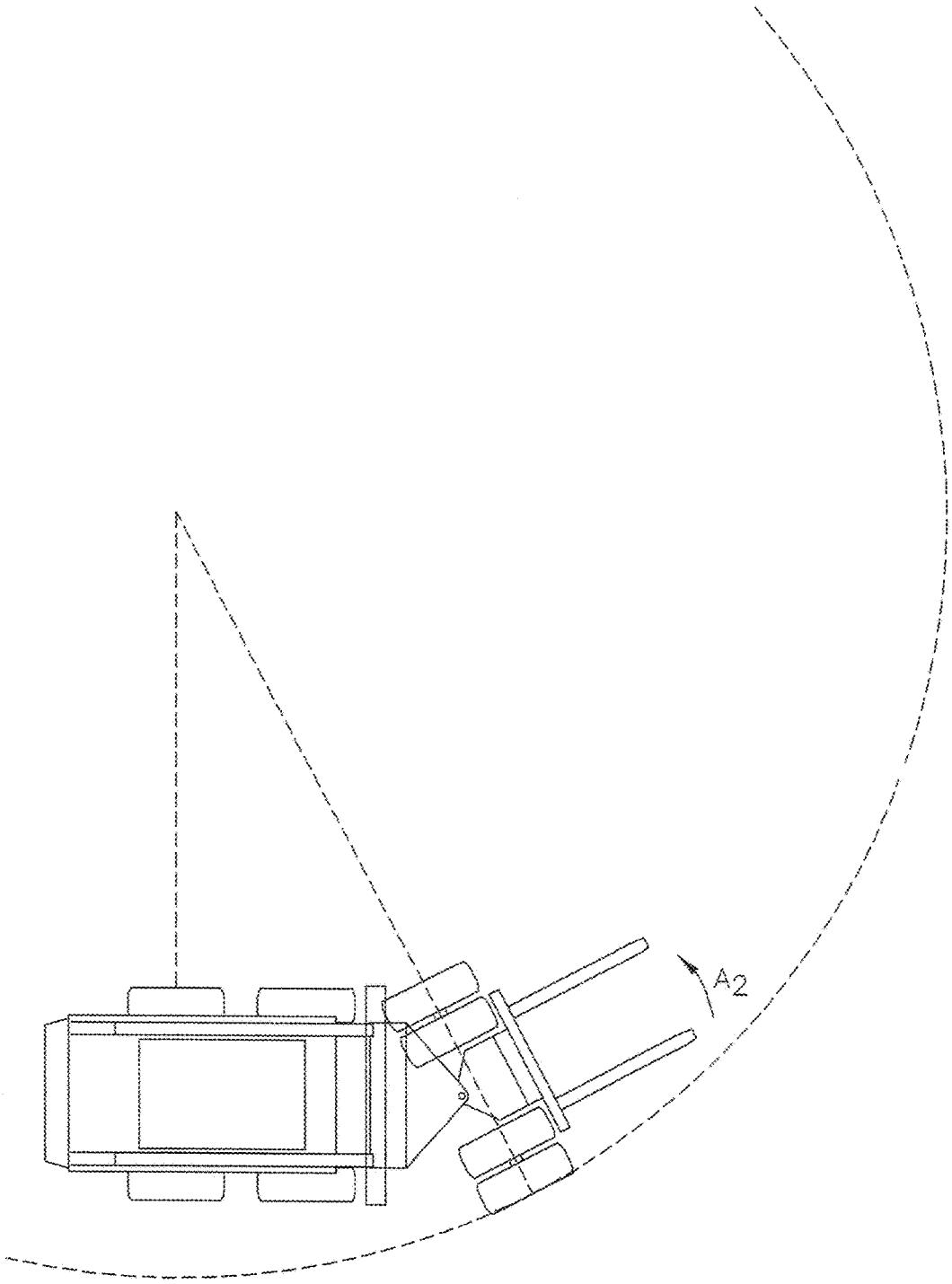

Referring to FIGS. 8A-8G, a lift attachment apparatus 800 according to an additional alternative embodiment of the present disclosure is shown. Lift attachment apparatus 800 may be configured as a forklift attachment for a loader. Lift attachment apparatus 800 may include an attachment plate 805. Attachment plate 805 may be configured to attach to a tilting plane of a loader. It is contemplated that attachment device 805 may be a quick attachment device in use with various types of attachments to connect with loaders. As shown in FIG. 8C, the dotted line closest to the loader may be exemplary wheel placement when turning while the other dotted line may refer wheel placement when moving in a generally straight direction.

Lift attachment apparatus 800 may include a forklift which may include at least one hydraulic cylinder to control the raising and lowering of the forklift. Additionally, lift attachment apparatus 800 may include a hydraulic cylinder to control steering of the lift attachment apparatus 800. It is contemplated that the lift attachment apparatus 800 may utilize at least one auxiliary hydraulic controller of the loader to control operation of the at least one hydraulic cylinder for the forklift operation and steering. It is contemplated that at least one hydraulic cylinder may be a single acting hydraulic cylinder, a double acting hydraulic cylinder, gears, chains or in combination, and further may be powered by electrical power. It is contemplated that force applied by at least one forward facing loader arm in a downward motion along with upward lift of a tipping mechanism of the loader may cause force that creates upward leverage with the wheels of the lift attachment apparatus 800. Lift attachment apparatus 800 may increase safe operating capacity far beyond a tipping capacity of a loader using the loaders arms and/or tipping function.

Lift attachment apparatus 800 may not include wheels centered on the load which may cause the load to bob back and forth while in motion at an amount determined by the play in the lifting components of the loader. Lift attachment apparatus 800 may include brakes. Brakes and a small battery to power the breaks may be set with a standard variable brake controller and may be activated by the parking brake on the loader with a kit a heavy equipment mechanic could install. With brakes, loader and lift attachment apparatus 800 may operate similar as a truck with a car trailer that has independent brakes. Lift attachment apparatus 800 may or may not need powered wheels that are operated with loader controls or tapped into the loader's left and right wheel hydraulics. It is contemplated that Lift attachment apparatus 800 may include a hitch for transport. Hitch may be a two inch interior width square pipe below the attachment plate being integrated with some safety chains. A two inch outside dimension square pipe with a coupler on the end may attach to a trailer ball on a vehicle. Forklift may further include additional forks to carry the weight, such as four forks. Four forks being needed is a very real possibility. It is contemplated that the hydraulic capacity may be at least 7,200 lbs with a Bobcat 2009 S205 skid-steer loader. The loader may not physically tip forward until the load exceeded 12,000 lbs, but the loader's hydraulic bypass may be activated prior to a load being lifted above its resting place, which may be much safer than a standalone loader with forks. Wheels of the attachment 800 may be located behind moving parts of the attachment and may allow access into limited access spaces.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A lift attachment apparatus, comprising:

a frame, the frame including:

an attachment device;

an axle; and a coupler device which connects the attachment device to the axle, the attachment device configured to attach to a tilting plane of a loader, the loader having a forward facing loader arm;

a pair of wheels directly connected to the axle of the frame, a first wheel of said pair of wheels located on a first side of the frame and a second wheel of said pair of wheels located on a second side of the frame, the first wheel configured to be maintained parallel to the second wheel; and a boom connected to the frame, the boom being generally fixed in a similar plane as the attachment device of the frame, wherein the boom is configured to be controlled by application of force to the attachment device by the forward facing loader arm in a downward direction to create lift and rotation of the tilting plane causing rotation of an end of the boom about the first wheel and the second wheel.

2. The lift attachment apparatus as claimed in claim 1, wherein the coupler is generally perpendicular to the attachment device of the frame.

3. The lift attachment apparatus as claimed in claim 1, wherein said boom is configured to be tipped up via reverse action of a hydraulic cylinder of the forward facing loader arm of the loader.

4. A lift attachment apparatus, comprising:

a frame, the frame including an attachment device configured to attach to a tilting plane of a loader, the loader including a forward facing loader arm;

a pair of wheels connected to the frame, a first wheel of said pair of wheels located on a first side of the frame and directly mounted to an end of an axle and a second wheel of said pair of wheels located on a second side of the frame and directly mounted to another end of the axle; and a boom connected to the frame, wherein the boom is configured to be controlled by application of force to the attachment device by the forward facing loader arm in a downward direction to create lift and rotation of the tilting plane causing rotation of an end of the boom about the first wheel and the second wheel.

5. The lift attachment apparatus as claimed in claim 4, wherein said boom further includes a connector configured to attach to an end of the boom.

6. The lift attachment apparatus as claimed in claim 5, wherein said connector includes a 90 degree connector, 45 degree connector or a straight connector.

7. The lift attachment apparatus as claimed in claim 4, wherein the attachment device includes a quick attachment device.

* * * * *